US007555820B2

(12) United States Patent
McEldowney et al.

(10) Patent No.: US 7,555,820 B2
(45) Date of Patent: Jul. 7, 2009

(54) METHODS FOR REMOVING BLIND FASTENERS

(75) Inventors: Paul A. McEldowney, Seattle, WA (US); Sujith N. Mally, Seattle, WA (US)

(73) Assignee: The Boeing Company, Chicago, IL (US)

( * ) Notice: Subject to any disclaimer, the term of this patent is extended or adjusted under 35 U.S.C. 154(b) by 702 days.

(21) Appl. No.: 11/042,753

(22) Filed: Jan. 24, 2005

(65) Prior Publication Data

US 2006/0165507 A1 Jul. 27, 2006

(51) Int. Cl.
*B23P 19/02* (2006.01)

(52) U.S. Cl. ..... 29/426.4

(58) Field of Classification Search ..... 29/426.4, 29/426.5, 414, 566; 411/34
See application file for complete search history.

(56) References Cited

U.S. PATENT DOCUMENTS

| | | | | |
|---|---|---|---|---|
| 1,873,250 | A | 8/1932 | Adolph | |
| 2,814,089 | A | 11/1957 | Bishop | |
| 3,071,848 | A | 1/1963 | Lawry et al. | |
| 6,568,062 | B1 * | 5/2003 | Opper et al. | 29/426.5 |

OTHER PUBLICATIONS

Adjustable Diameter Fasterner; http://www.avibank.com/products/category_display.cfm?category_id=2; accessed Jan. 24, 2005.
OSI-Bolt, High Strength Fasterner for Primary Structure; Monogram Aerospace Fasteners; 16 pgs; www.MonogramAerospace.com; (date unknown).
Three Dimensional Fasteners; www.monogramaerospace.com/products/abc/pin1.html.
PCT International Search Report for International Application No. PCT/US2006/001607, Applicant: The Boeing Company, Date of Mailing: May 22, 2006, 5 pages.

* cited by examiner

*Primary Examiner*—John C Hong
(74) *Attorney, Agent, or Firm*—Perkins Coie LLP

(57) ABSTRACT

Various methods and apparatuses for removing blind fasteners, portions of blind fasteners, and/or other fasteners from structural assemblies are described herein. In one embodiment, a blind fastener can have a core bolt extending through a passage in a body. One method for removing the blind fastener from a structural assembly in accordance with one aspect of the invention can include removing a head portion from the core bolt, and driving the remaining portion of the core bolt at least partially through the body in a first direction. The method can further include extracting the body from the bore in a second direction opposite to the first direction. In one embodiment, the body can be extracted from the bore by inserting a tool into the passage and engaging the body, and then pulling the body in the second direction with the tool.

18 Claims, 8 Drawing Sheets

METHODS FOR REMOVING BLIND FASTENERS

TECHNICAL FIELD

The following disclosure relates generally to blind fasteners and, more particularly, to methods and apparatuses for removing blind fasteners.

BACKGROUND

The term "blind fastener" is often used to describe a fastener that can be fully installed from a single side of a structural assembly. Pop rivets and one-sided installation (OSI) bolts are two known types of blind fasteners. FIGS. 1A and 1B are partial cross-sectional views illustrating two stages in a method of installing a prior art blind fastener 100, and FIG. 1C is an end view of the blind fastener 100. Referring first to FIG. 1A, the blind fastener 100 includes a core bolt 110 extending through a passage 109 in a body 112. The core bolt 110 includes an exposed stem 118 and an externally threaded portion 115. The externally threaded portion 115 engages a nut 116. The nut 116 bears against a sleeve 114. As shown in FIG. 1C, the stem 118 of the core bolt 110 includes flats 111*a* and 111*b*, and the body 112 includes a head portion 119 (e.a., a countersunk head portion) having a plurality of recesses 113 (identified individually as recesses 113*a-d*).

Returning to FIG. 1A, to install the blind fastener 100, it is first inserted through a bore 104 in a first part 101 and a second part 102. A minimum distance D1 is required between the second part 102 and a third part 103 to provide clearance for the blind fastener 100 during installation. Next, prongs on a nose adapter of an installation tool (not shown) are engaged with the recesses 113 in the head portion 119 to prevent rotation of the body 112. A wrench adapter on the installation tool then engages the flats 111 on the core bolt stem 118 and rotates the core bolt 110 about its longitudinal axis. Rotation of the core bolt 110 in this manner causes the nut 116 to move toward the body 112. As this happens, the sleeve 114 flares out over the body 112 and presses against the second part 102 as shown in FIG. 1B. As the sleeve 114 is compressed, the core bolt stem 118 becomes harder and harder to turn until ultimately the stem 118 breaks off at a preset torque level. The foregoing installation procedure and related fastener details are described in the product specification entitled "OSI-BOLT™—HIGH STRENGTH FASTENER FOR PRIMARY STRUCTURE" provided by Monogram Aerospace Fasteners, Inc. of 3423 South Garfield Avenue, Los Angeles, Calif. 90022, and in U.S. Pat. Nos. 5,498,110 and 5,634,751, all of which are incorporated herein in their entireties by reference.

FIGS. 2A-2F are partial cross-sectional views illustrating a method for removing the blind fastener 100 from the first part 101 and the second part 102 in accordance with the prior art. Referring first to FIG. 2A, the method involves use of a drill tool 200 having a drill bit 204 rotatably disposed in an adapter 206. A plurality of prongs 202 (identified individually as a first prong 202*a* and a second prong 202*b*) extending outwardly from the adapter 206 engage the corresponding recesses 113 in the head portion 119 of the fastener body 112. The prongs 202 prevent the body 112 from rotating while the drill bit 204 removes a head portion 221 of the core bolt 110, as shown in FIG. 2B.

Referring next to FIG. 2C, after the head portion 221 of the core bolt 110 has been removed, a punch 230 is used to drive the remaining portion of the core bolt 110 out the backside of the fastener body 112. As shown in FIG. 2D, an increased backside clearance D2 is required between the second part 102 and the third part 103 to ensure that the core bolt 110 will fall clear of the body 112.

Referring next to FIG. 2E, a pilot tip 242 of an end mill 240 is inserted into the body 112, and a cutter portion 244 of the end mill 240 removes the head portion 119 of the body 112. As shown in FIG. 2F, a piloted rivet set 232 or other suitable tool is then inserted through the bore 104 and used to drive the body 112 out the backside of the bore 104.

As FIG. 1A illustrates, the minimum backside clearance D1 is all that is required to adequately install the blind fastener 100. As shown in FIG. 2D, however, removal of the blind fastener 100 by the method described above requires increasing the backside clearance to D2. Increasing the backside clearance from D1 to D2 solely for the purpose of fastener removal results in a larger structural assembly than would otherwise be required. In aircraft and other structures, the disadvantages of a larger structural assembly include an increase in structural weight and a decrease in usable space.

SUMMARY

The following summary is provided for the benefit of the reader only, and does not limit the invention as set forth by the claims. The present invention is directed generally toward methods and apparatuses for removing blind fasteners from aircraft structures and other assemblies. A method in accordance with one aspect of the invention can be used to remove a blind fastener from a bore. The blind fastener can have a core bolt extending through a passage in a body. The method can include removing a head portion from the core bolt and driving a remaining portion of the core bolt through the passage in the body in a first direction. The method can further include extracting the body from the bore in a second direction opposite to the first direction. In one embodiment, extracting the body from the bore can include inserting a tool into the passage and pulling the body in the second direction with the tool.

A method for detaching a first aircraft part from a second aircraft part in accordance with another aspect of the invention includes identifying at least one fastener attaching the first aircraft part to the second aircraft part. When the fastener is a blind fastener having a core bolt extending through a passage in a body, the method can further include removing a head portion from the core bolt and driving a remaining portion of the core bolt through the passage in the body in a first direction. The method can further include extracting the body from the first and second aircraft parts in a second direction opposite to the first direction. In one embodiment, the first and second aircraft parts can define an accessible front side and an inaccessible backside of an aircraft structure assembly. In this embodiment, removing a head portion from the core bolt can include cutting the head portion from the front side of the structural assembly.

DETAILED DESCRIPTION

The following disclosure describes various methods and apparatuses for removing blind fasteners from structural assemblies. Certain details are set forth in the following description to provide a thorough understanding of various embodiments of the invention. Other details describing well-known structures and systems often associated with one-sided installation bolts and other blind fasteners are not set forth, however, to avoid unnecessarily obscuring the description of the various embodiments of the invention.

Many of the details, dimensions, angles and other features shown in the Figures are merely illustrative of particular embodiments of the invention. Accordingly, other embodiments can have other details, dimensions, angles and features without departing from the spirit or scope of the present invention. Furthermore, additional embodiments of the invention can be practiced without several of the details described below.

In the Figures, identical reference numbers identify identical or at least generally similar elements. To facilitate the discussion of any particular element, the most significant digit or digits of any reference number refer to the Figure in which that element is first introduced. For example, element 303 is first introduced and discussed with reference to FIG. 3.

Figure 1A:
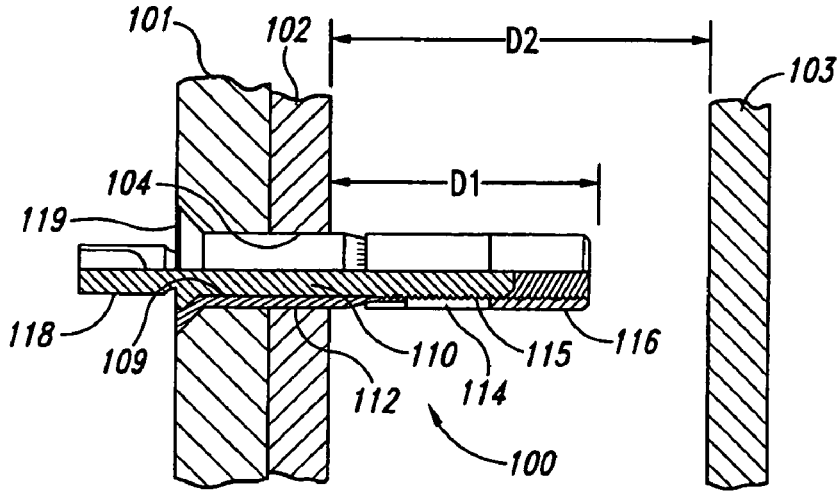
Fig. 1A (Prior Art)
FIGS. 1A-1B are partial cross-sectional views illustrating a method for installing a blind fastener in accordance with the prior art.
Figure 1B:
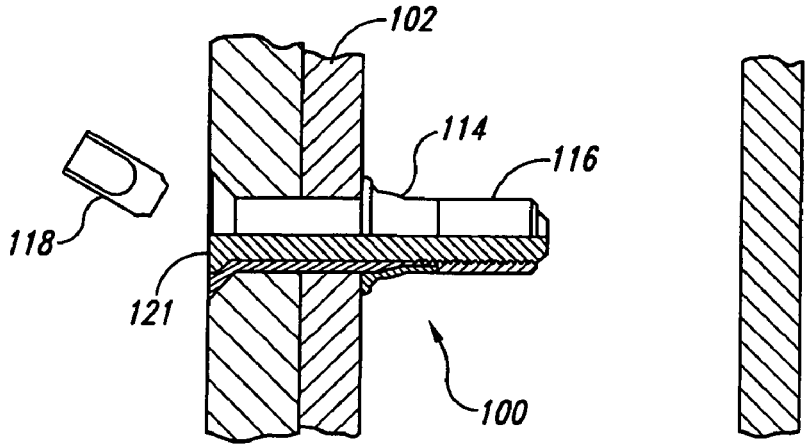
Fig. 1B (Prior Art)
Figure 1C:
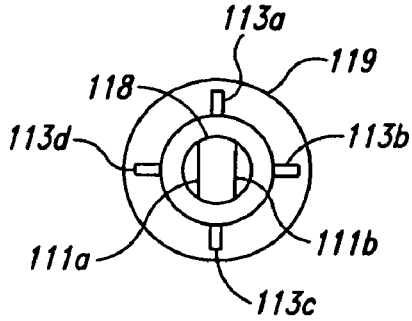
Fig. 1C (Prior Art)
FIG. 1C is an end view of the blind fastener.
Figure 3A:
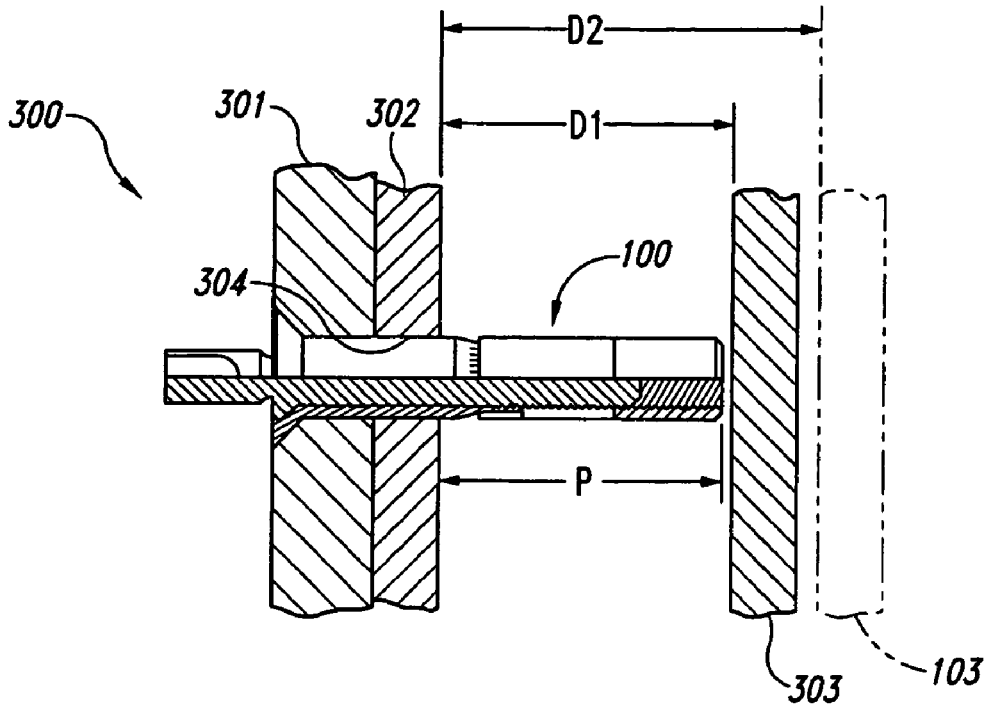
FIGS. 3A-3B are partial cross-sectional views illustrating an installation of the blind fastener of FIGS. 1A-1C in a structural assembly configured in accordance with an embodiment of the invention.
Figure 3B:
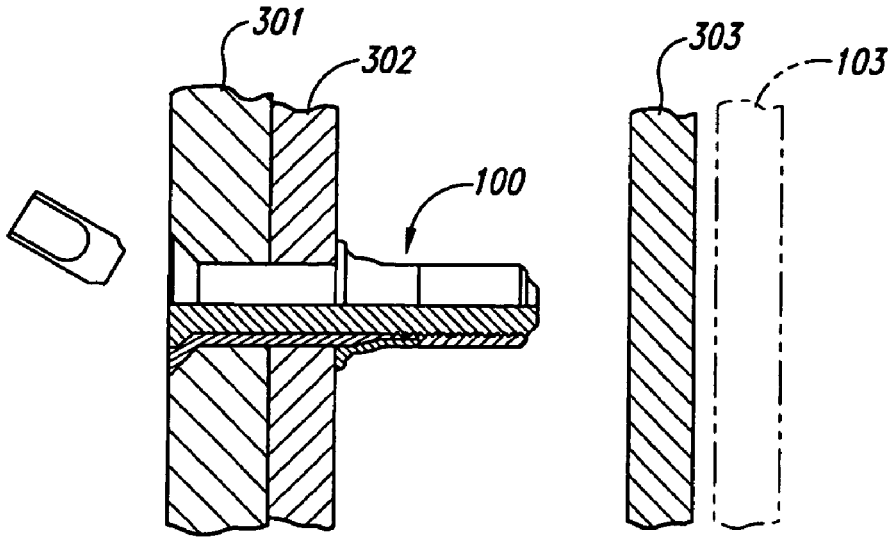

FIGS. 3A and 3B are partial cross-sectional views illustrating an installation of the blind fastener 100 in a structural assembly 300 configured in accordance with an embodiment of the invention. Referring to these Figures together, the structural assembly 300 includes a first part 301 (e.g., a first aircraft part) positioned against a second part 302 (e.g., a second aircraft part). The blind fastener 100 can be installed in the first part 301 and the second part 301 using the method described above with reference to FIGS. 1A-1C.

In one aspect of this embodiment, the second part 302 is spaced apart from a third part 303 by the minimum backside clearance D1 discussed above with reference to FIG. 1A. As the reader will observe, the minimum backside clearance D1 is considerably less than the increased backside clearance D2 used in the prior art structural assembly described above with reference to FIGS. 1A-1C. In fact, the minimum backside clearance D1 is only slightly greater than a length P of the portion of the blind fastener 100 protruding from the second part 302. Even though the minimum backside clearance D1 of the present invention is considerably less than the increased backside clearance D2 of the prior art, the blind fastener 100 can still be easily removed from the structural assembly 300 by using the method described below with reference to FIGS. 4A-4D.

Figure 2A:
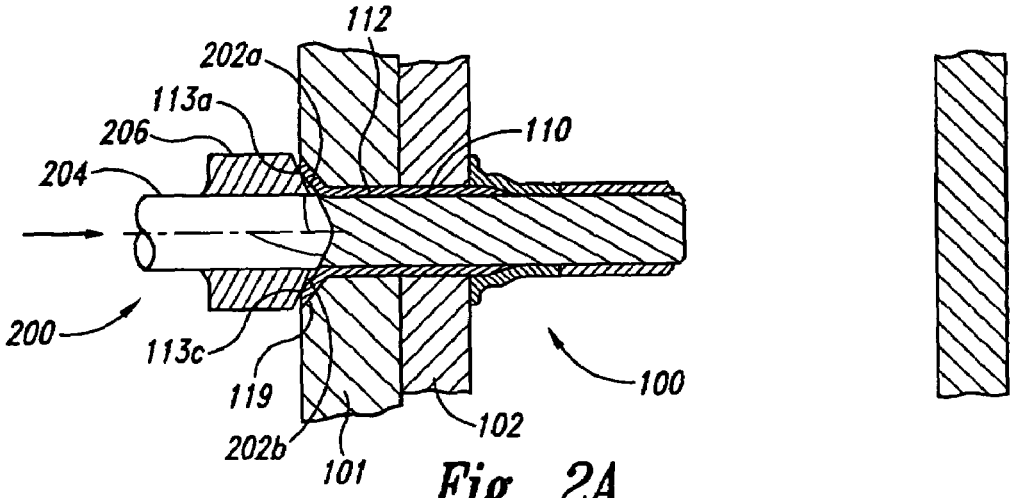
Fig. 2A (Prior Art)
FIGS. 2A-2F are partial cross-sectional views illustrating a method for removing the blind fastener of FIGS. 1A-1C in accordance with the prior art.
Figure 2B:
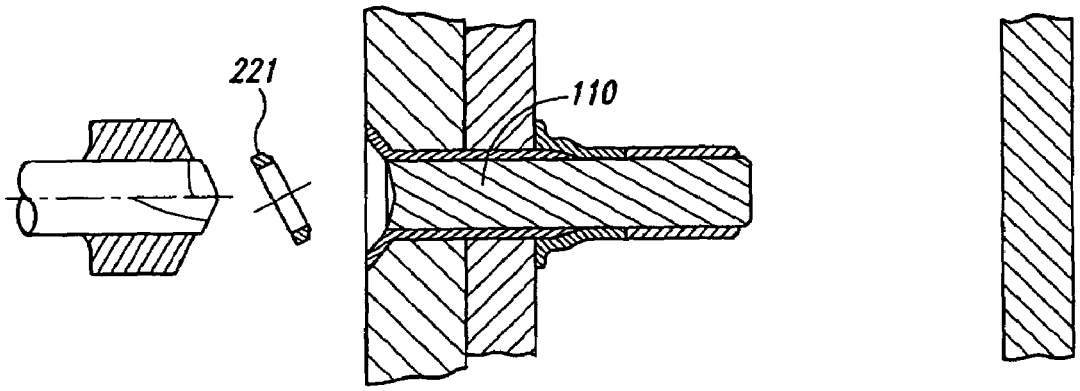
Fig. 2B (Prior Art)
Figure 2C:
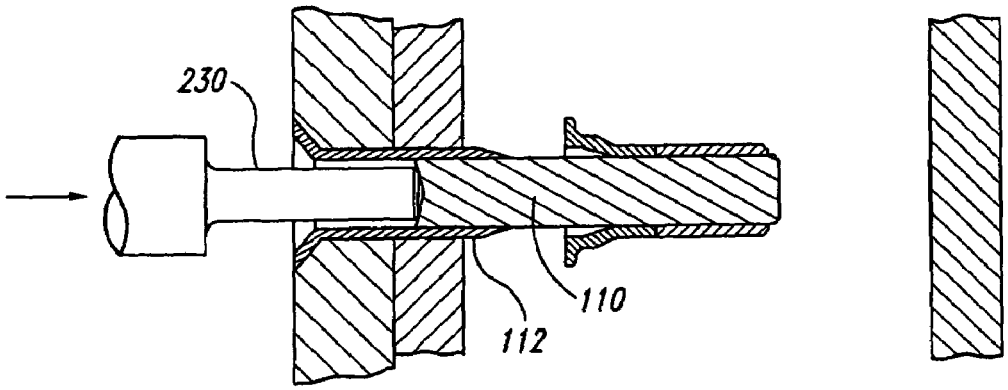
Fig. 2C (Prior Art)
Figure 2D:
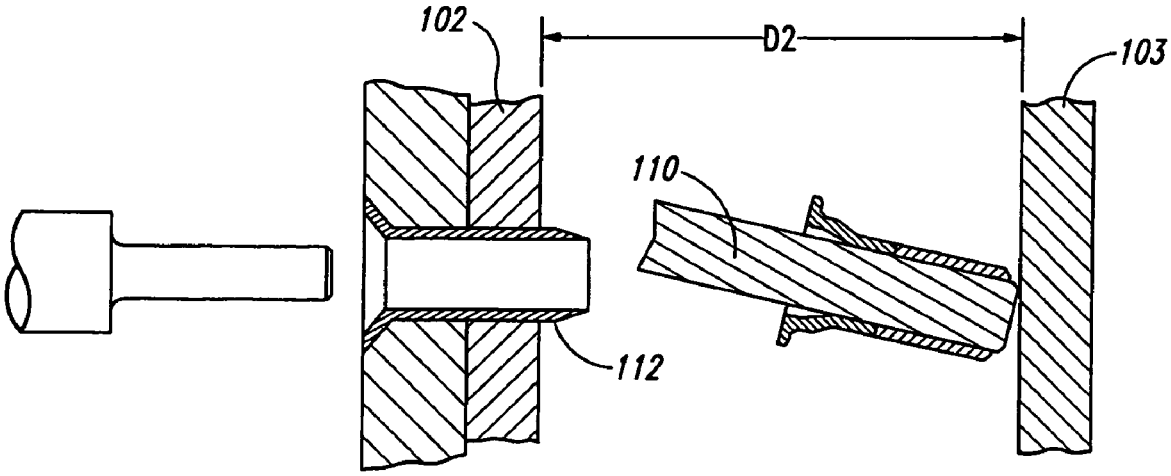
Fig. 2D (Prior Art)
Figure 2E:
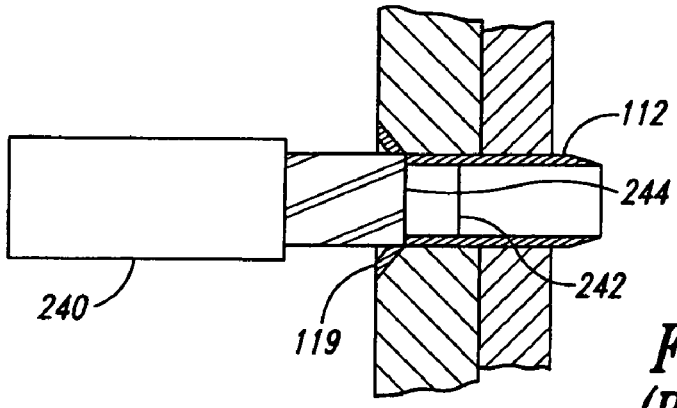
Fig. 2E (Prior Art)
Figure 2F:
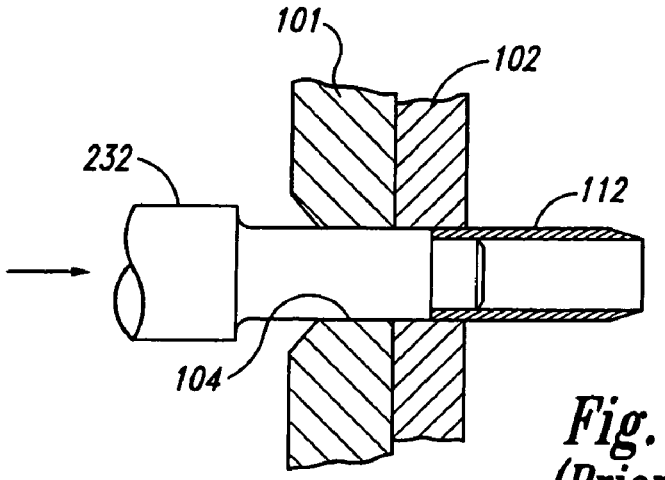
Fig. 2F (Prior Art)
Figure 4A:
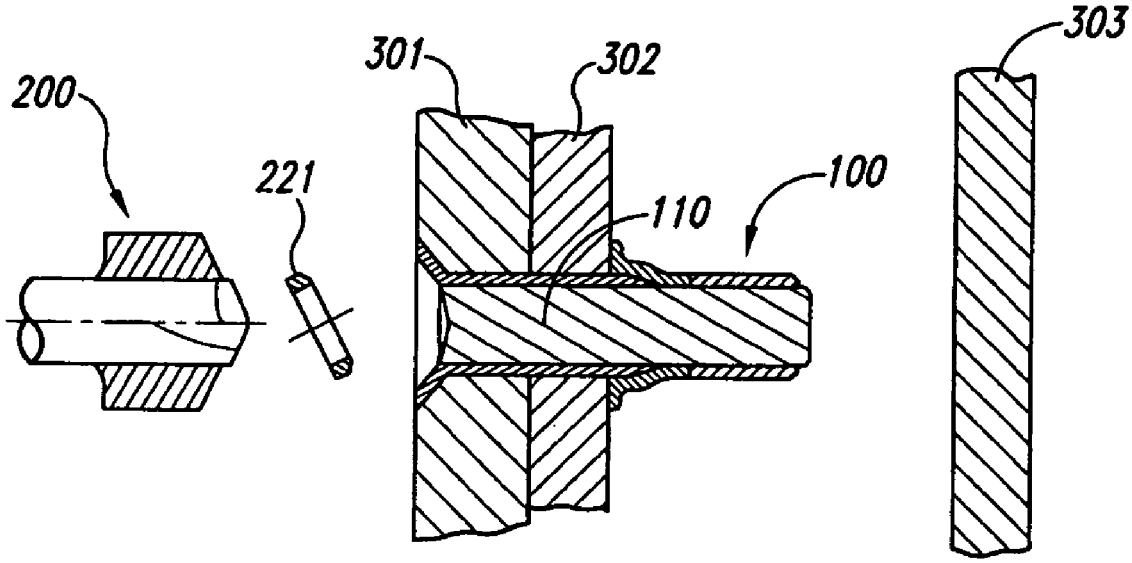
FIGS. 4A-4D are partial cross-sectional views illustrating a method for removing the blind fastener of FIGS. 1A-1C in accordance with an embodiment of the invention.

FIGS. 4A-4D are partial cross-sectional views illustrating a method for removing the blind fastener 100 from the first part 301 and the second part 302 in accordance with an embodiment of the invention. Referring first to FIG. 4A, the head portion 221 of the core bolt 110 is removed using the drill tool 200 as described above with reference to FIGS. 2A and 2B. In other embodiments, other suitable tools and/or methods can be used to remove the head portion 221 from the core bolt 110. Such methods can include, for example, the use of an end mill, grinder, chisel, or other tool.

Figure 4B:
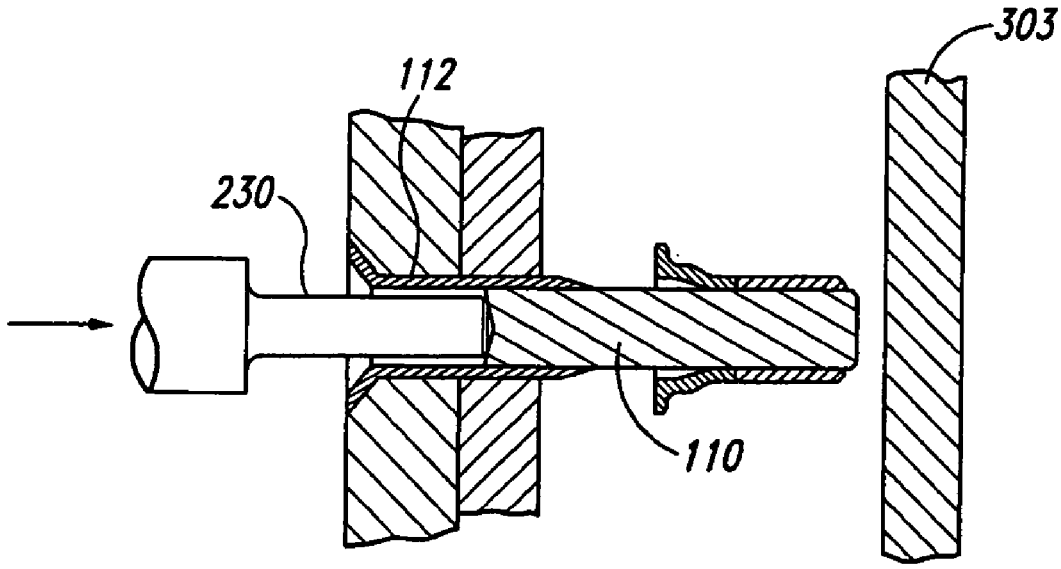

Referring next to FIG. 4B, after the head portion 221 of the core bolt 110 has been removed, the punch 230 or other suitable tool is inserted into the body 112 and brought to bear against the remaining portion of the core bolt 110. The punch 230 is then used to drive the core bolt 110 outwardly toward the third part 303. The close proximity of the third part 303 to the second part 302, however, prevents the core bolt 110 from being driven completely out of the fastener body 112.

Figure 4C:
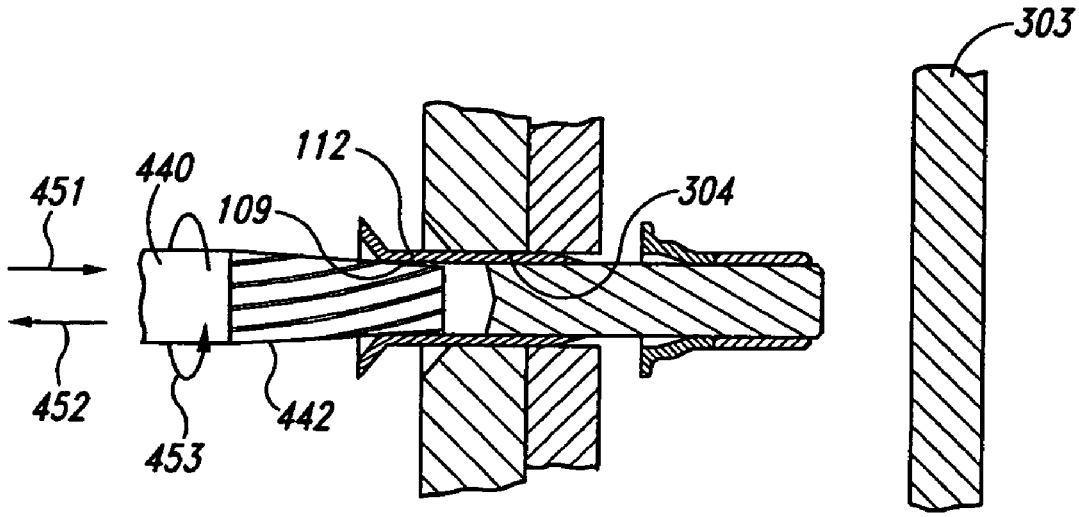

As shown in FIG. 4C, once the core bolt 110 has been driven partially through the body 112, a fastener body removal tool 440 ("removal tool 440") is inserted into the body 112. In the illustrated embodiment, the removal tool 440 includes a screw extractor or similar device (e.g., a "Back-Out") having a tapered portion 442 with a plurality of reverse-direction threads configured to engage the interior walls of the passage 109. The tapered portion 442 is inserted into the passage 109 in a first direction 451, and then rotated in a counterclockwise direction 453 to engage the body 112. The removal tool 440 can then be pulled in a second direction 452 to extract the body 112 from the bore 304.

Figure 4D:
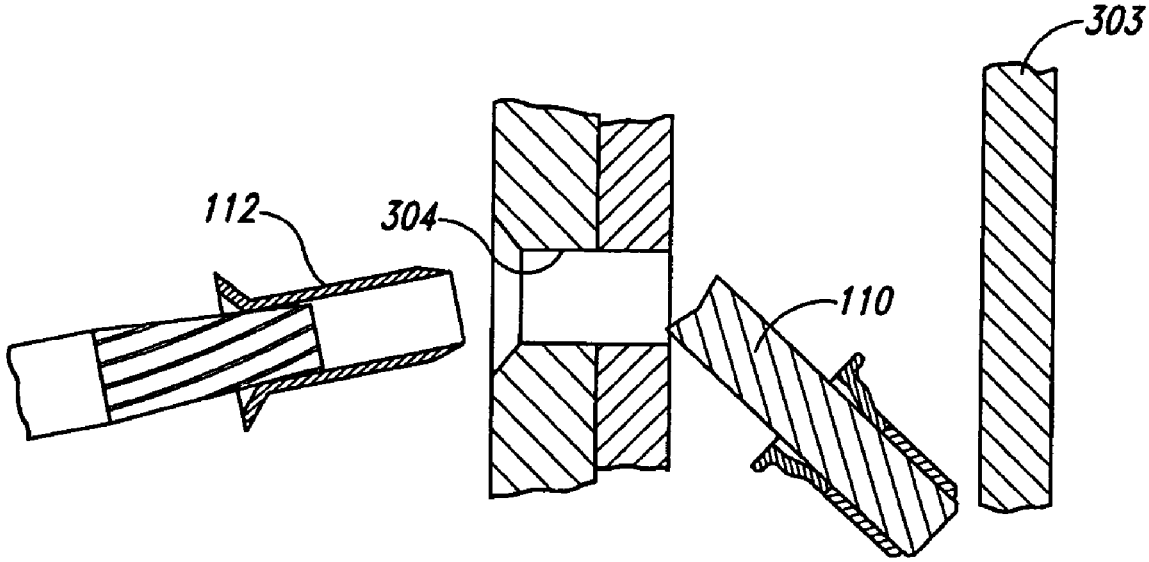

Referring next to FIG. 4D, once the body 112 has been extracted from the bore 304, the core bolt 110 will be left laying in what is essentially an oversized hole. As a result, the core bolt 110 can be easily tapped out of the bore 304 at an angle sufficient to clear the third part 303.

As mentioned above with reference to FIG. 3A, one feature of the illustrated embodiment is that the minimum distance between the second part 302 and the third part 303 can be reduced to D1, which is only slightly greater than the length P of the portion of the blind fastener 100 protruding beyond the second part 302. One advantage of this feature is that it allows the structural assembly 300 to be made smaller and lighter than the prior art structural assembly described above with reference to FIGS. 1A-2F. Further, the fastener removal method described herein provides the additional advantage of allowing blind fasteners, such as the blind fastener 100, to be retrofit in those structural assemblies that heretofore did not provide sufficient backside clearance for fastener removal. As a result, the blind fastener 100 and other fasteners of similar configuration can now be used in a number of applications that were previously considered unfeasible.

Figure 5C:
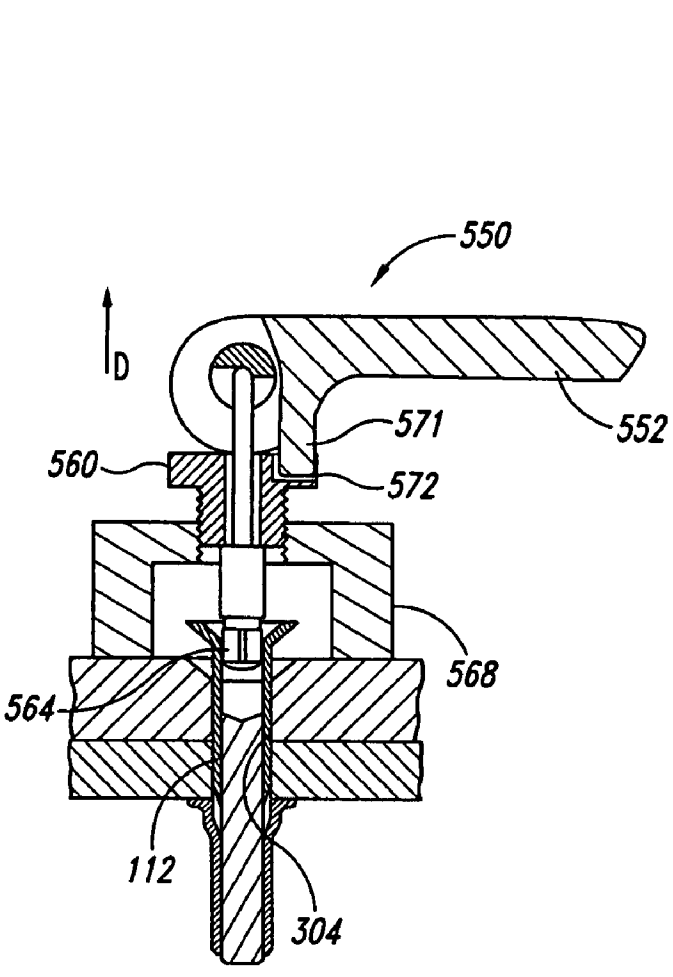
FIGS. 5A-5C are various side cross-sectional views of a blind fastener removal tool configured in accordance with another embodiment of the invention.
Figure 5B:
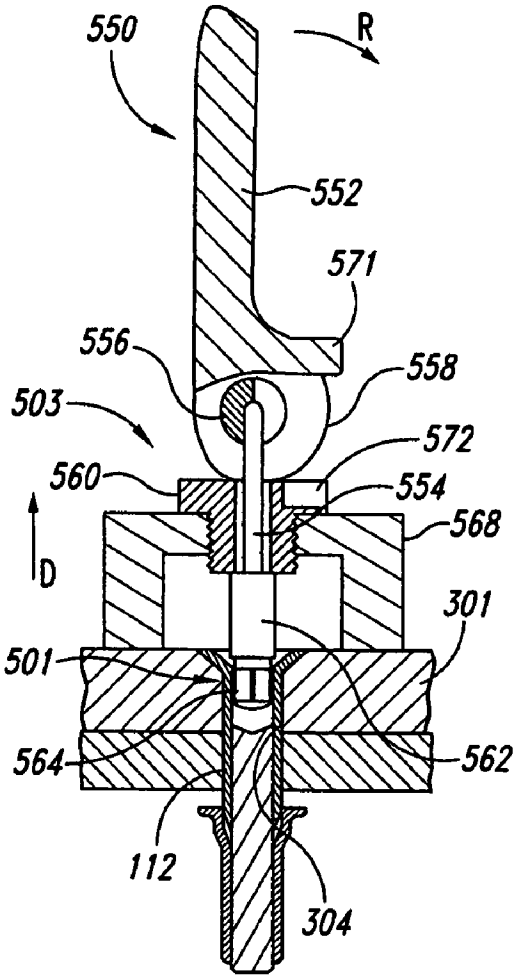
Figure 5A:
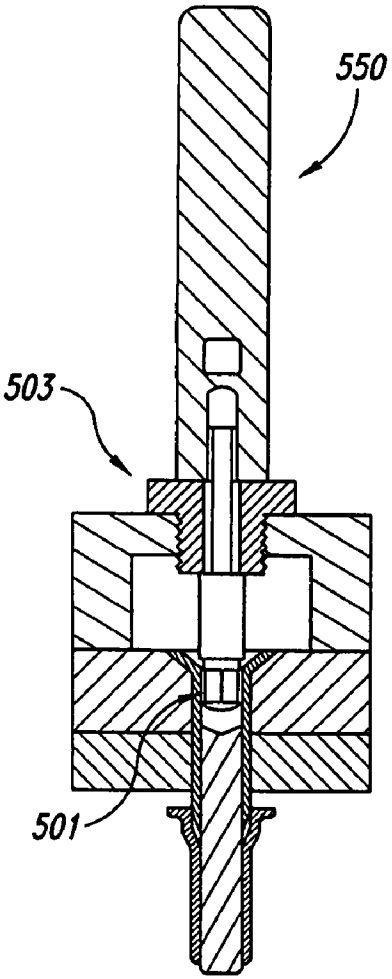

FIGS. 5A-5C are various side cross-sectional views of a fastener body removal tool 550 ("removal tool 550") configured in accordance with an embodiment of the invention. Referring first to FIGS. 5A and 5B, the removal tool 550 includes an engagement portion 501 operably coupled to a pulling portion 503. The engagement portion 501 is configured to engage an interior portion of the fastener body 112. The pulling portion 503 is configured to extract the fastener body 112 from the bore 304 after the engagement portion 501 has been engaged with the fastener body 112.

In the illustrated embodiment, the engagement portion 501 includes an expanding sleeve 564 carried by a distal end portion of a core pin 554. The core pin 554 extends through a spacer 562 and a threaded bushing 560, and is pivotally coupled to a cam 558 by means of a barrel nut 556. A user-operable handle 552 extends outwardly from the cam 558. Rotation of the handle 552 in direction R causes the cam 558 to rotate against the bushing 560, thereby drawing the core pin 554 through the bushing 560 in direction D. As described in greater detail below, this movement of the core pin 554 causes the expanding sleeve 564 to expand outwardly and engage the fastener body 112. As shown in FIG. 5C, when the handle 552 has been fully rotated in direction R, a tab 571 extending outwardly from the handle 552 is received by a notch 572 in the threaded bushing 560.

In the illustrated embodiment, the pulling portion 503 includes the bushing 560 which is threaded into a support 568. The support 568 is configured to contact the first part 301 and position the engagement portion 501 relative to the fastener body 112. Once the tab 571 on the handle 552 has been received by the notch 572 in the bushing 560, the handle 552 can be rotated counterclockwise to unthread the bushing 560 from the support 568. As shown in FIG. 5C, as the bushing 560 moves away from the support 568 in direction D, the engagement portion 501 extracts the fastener body 112 from the bore 304.

Figure 6A:
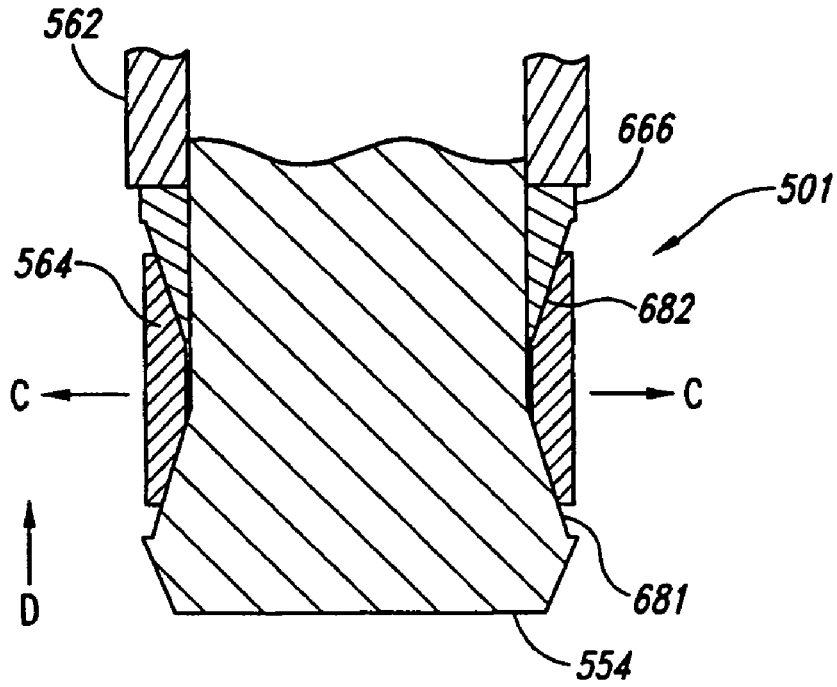
FIGS. 6A and 6B are enlarged cross-sectional views of the fastener engagement portion of the blind fastener removal tool of FIGS. 5A-5C.
Figure 6B:
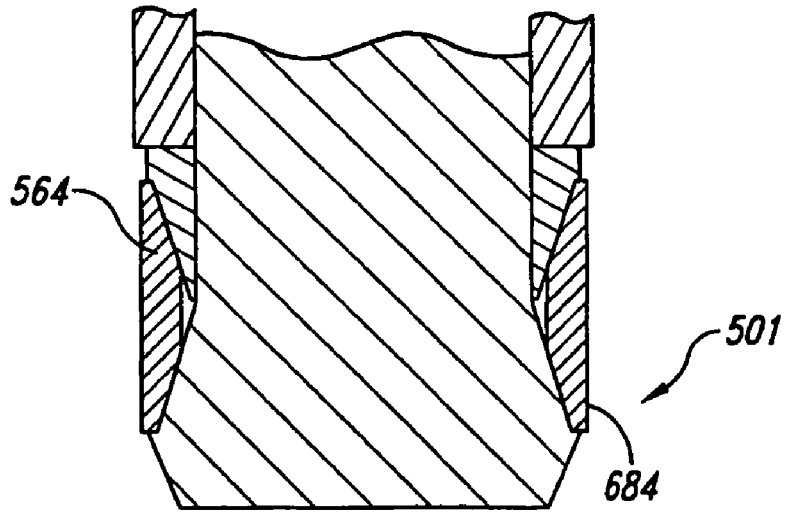

FIGS. 6A and 6B are enlarged cross-sectional views illustrating operation of the engagement portion 501 of the removal tool 550 described above with reference to FIGS. 5A-C. Referring first to FIG. 6A, the expanding sleeve 564 is captured between a first tapered surface 681 of the core pin 554 and a second tapered surface 682 of a sleeve expander 666. The sleeve expander 666 is a ring-shaped member that bears against the spacer 562. As the tip of the core pin 554 moves toward the sleeve expander 666, the first tapered surface 681 cooperates with the second tapered surface 682 to force the expanding sleeve 564 outward in direction C, as shown in FIG. 6B. When the expanding sleeve 564 is positioned within a fastener body (e.g., the fastener body 112 of FIGS. 5A-C), this expansion causes the expanding sleeve 564 to press against the fastener body and firmly grip it for subsequent removal. Although not illustrated in FIGS. 6A-B, the expanding sleeve 564 includes a longitudinal cut at one location that enables it to expand and contract. In addition, the expanding sleeve 564 can also include various serrations, knurling, and/or other surface features on an outer surface 684 to enhance the ability of the expanding ring to grip fastener bodies for removal.

From the foregoing, it will be appreciated that specific embodiments of the invention have been described herein for purposes of illustration, but that various modifications may be made without deviating from the spirit and scope of the invention. For example, aspects of the invention described in the context of particular embodiments may be combined or eliminated in other embodiments. Further, while advantages associated with certain embodiments of the invention have been described in the context of those embodiments, other embodiments may also exhibit such advantages, and no embodiment need necessarily exhibit such advantages to fall within the scope of the invention. Accordingly, the invention is not limited, except as by the appended claims.

We claim:

1. A method for removing a blind fastener from a bore, the blind fastener having a core bolt extending through a passage in a body, the method comprising:

removing a head portion from the core bolt;

driving a remaining portion of the core bolt partially through the passage in the body in a first direction; and extracting the body from the bore in a second direction, opposite to the first direction, whereby the remaining portion of the core bolt remains at least temporarily supported by the body while the body is being extracted from the bore in the second direction.

2. The method of claim 1 wherein extracting the body from the bore includes inserting a tool into the passage and pulling the body in the second direction with the tool.

3. The method of claim 1 wherein the head portion of the core bolt is a first head portion, and wherein extracting the body from the bore includes inserting a tool through a second head portion of the body and pulling the body in the second direction with the tool.

4. The method of claim 1 wherein extracting the body from the bore includes engaging a threaded portion of a tool with an interior portion of the body and pulling the body in the second direction with the tool.

5. The method of claim 1 wherein extracting the body from the bore includes engaging an interior portion of the body with a screw extractor and pulling the body in the second direction with the screw extractor.

6. The method of claim 1 wherein extracting the body from the bore includes inserting a tool into the passage while the remaining portion of the core bolt is at least temporarily supported by the body, and pulling the body in the second direction with the tool.

7. The method of claim 1 wherein the head portion of the core bolt is a first head portion, and wherein removing the first head portion from the core bolt includes engaging a second head portion of the body to prevent the body from rotating about a longitudinal axis.

8. The method of claim 7 wherein engaging a second head portion of the body includes engaging a countersunk head portion.

9. The method of claim 7 wherein engaging a second head portion of the body includes engaging a countersunk head portion by inserting at least a first prong into a first recess in the countersunk head portion.

10. The method of claim 7 wherein engaging a second head portion of the body includes engaging a countersunk head portion by inserting at least a first prong on a cutting tool adapter into a first recess in the countersunk head portion, and wherein removing the first head portion from the core bolt further includes cutting the first head portion with a rotating cutter positioned within the cutting tool adapter.

11. A method of detaching a first aircraft part from a second aircraft part, the method comprising:

identifying at least one fastener attaching the first aircraft part to the second aircraft part;

when the fastener is a blind fastener having a core bolt extending through a passage in a body:

removing a head portion from the core bolt;

driving a remaining portion of the core bolt partially through the passage in the body in a first direction; and extracting the body from the first and second aircraft parts in a second direction, opposite to the first direction, whereby the remaining portion of the core bolt remains at least temporarily supported by the body while the body is being extracted from the first and second aircraft parts.

12. The method of claim 11 wherein the first and second aircraft parts define an accessible front side and an inaccessible backside of an aircraft structural assembly, and wherein removing a head portion from the core bolt includes cuffing the head portion from the front side of the structural assembly.

13. The method of claim 11 wherein the first and second aircraft parts define an accessible front side and an inaccessible backside of an aircraft structural assembly, wherein removing a head portion from the core bolt includes cutting the head portion from the front side of the structural assembly, and wherein extracting the body from the first and second aircraft parts includes separating the body from the remaining portion of the core bolt and causing the remaining portion to fall free of the first and second aircraft parts on the backside of the aircraft structural assembly.

14. The method of claim 11 wherein extracting the body from the first and second aircraft parts includes inserting a tool into the passage while the remaining portion of the core bolt is at least temporarily supported by the body, and pulling the body in the second direction with the tool.

15. A system for removing a blind fastener from a bore, the blind fastener having a core bolt extending through a passage in a body, the method comprising:

means for removing a head portion from the core bolt;

means for driving a remaining portion of the core bolt partially through the passage in the body in a first direction; and means for extracting the body from the bore in a second direction, opposite to the first direction, whereby the remaining portion of the core bolt remains at least temporarily supported by the body while the body is being extracted from the bore in the second direction.

16. The system of claim 15 wherein the means for extracting the body from the bore include means for engaging the body and pulling the body in the second direction.

17. The system of claim 15 wherein the head portion of the core bolt is a first head portion, and wherein the means for extracting the body from the bore include means for engaging the body and pulling the body in the second direction while leaving a second head portion of the body intact.

18. The system of claim 15 wherein the means for driving a remaining portion of the core bolt include means for driving the remaining portion partially through the passage in the body without separating the remaining portion from the body.

* * * * *